US008647800B2

(12) United States Patent
Isono et al.

(10) Patent No.: US 8,647,800 B2
(45) Date of Patent: Feb. 11, 2014

(54) TONER

(71) Applicant: Canon Kabushiki Kaisha, Tokyo (JP)

(72) Inventors: Naoya Isono, Suntou-gun (JP); Katsuyuki Nonaka, Mishima (JP); Kenichi Nakayama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/871,893

(22) Filed: Apr. 26, 2013

(65) Prior Publication Data

US 2013/0252163 A1 Sep. 26, 2013

Related U.S. Application Data

(63) Continuation of application No. PCT/JP2012/080867, filed on Nov. 29, 2012.

(30) Foreign Application Priority Data

Dec. 28, 2011 (JP) ..... 2011-288797

(51) Int. Cl.
*G03G 9/097* (2006.01)

(52) U.S. Cl.
USPC ..... 430/108.8; 430/108.1

(58) Field of Classification Search
USPC ..... 430/108.1, 108.8
See application file for complete search history.

(56) References Cited

U.S. PATENT DOCUMENTS

2006/0057484 A1 * 3/2006 Tsurumi et al. ..... 430/108.8

FOREIGN PATENT DOCUMENTS

| | | | |
|---|---|---|---|
| JP | 11-327193 | A | 11/1999 |
| JP | 2000-321815 | A | 11/2000 |
| JP | 2006-84661 | A | 3/2006 |
| JP | 3852354 | B | 11/2006 |
| JP | 2008-015450 | A | 1/2008 |
| JP | 2011-081042 | A | 4/2011 |

* cited by examiner

*Primary Examiner* — Peter Vajda
(74) *Attorney, Agent, or Firm* — Canon U.S.A., Inc., IP Division

(57) ABSTRACT

Provided is a toner capable of suppressing the bleeding of wax to the surface of the toner to maintain a high electrophotograph property while maintaining a broad fixing temperature range and capable of reducing interior contamination in long-term use. The toner includes toner particles, each of which contains a binder resin, a colorant, and a wax. The toner has a softening point of 75° C. or more and 110° C. or less measured by a constant-pressure-extrusion-type capillary rheometer. The wax is a hydrocarbon wax composed of a hydrocarbon compound. The hydrocarbon wax has specific abundance ratios each corresponding to a specific carbon number range of hydrocarbon compounds.

8 Claims, 3 Drawing Sheets

TONER

CROSS-REFERENCE TO RELATED APPLICATIONS

This application is a Continuation of International Patent Application No. PCT/JP2012/080867, filed Nov. 29, 2012, which claims the benefit of Japanese Patent Application No. 2011-288797, filed Dec. 28, 2011, both of which are hereby incorporated by reference herein in their entirety.

TECHNICAL FIELD

The present invention relates to a toner used in image-forming methods such as electrophotography, electrostatic recording, and toner jet recording.

BACKGROUND ART

An image-forming method for developing electrostatic latent images is employed in copiers, multifunction printers, and printers. Such an image-forming method generally includes forming an electrostatic latent image on a photoreceptor, developing the electrostatic latent image using toner to form a toner image, transferring the toner image to a transfer material such as paper, and fixing the toner image to the transfer material by a heat-and-pressure fixing method to form a fixed image.

Various methods for fixing a toner image to a transfer material such as paper have been developed. Examples of such methods include a hot-roller fixing method of fixing a toner image to a transfer material using a hot roller and a pressure roller and a film fixing method of fixing a toner image to a transfer material by bringing a heating element and a pressure member into contact using a film interposed therebetween.

In these fixing methods, the surface of the hot roller or film and the toner image on the transfer material are brought into contact with each other. Consequently, the thermal efficiency with which the toner image is fused to the transfer material is high, which leads to quick fixing. Therefore, these fixing methods are widely employed in multifunction printers and printers.

However, in the fixing methods, some toner may adhere to the surface of the fixing member because the surface of the hot roller or the fixing member such as a film and the toner are brought into contact with each other when the toner is fused. As a result, an offset phenomenon, i.e., retransfer of the toner adhered to the hot roller or film to the next transfer material, may occur. In order to address such a problem, a toner that contains a wax such as paraffin or low-molecular-weight polyolefin in the toner particles so as to suppress the adhesion of the toner to the fixing member has been proposed (see PTL 1). In order to maintain the release effect of wax even when a fixing temperature is in low-temperature range and in high-temperature range, a toner that contains both a low-melting point wax and high-melting point wax has been proposed (see PTL 2). As a result, the occurrence of the toner offset to a fixing member was reduced and the stable fixability of toner over broad temperature range was achieved.

CITATION LIST

Patent Literature

PTL 1 Japanese Patent Laid-Open No. 2006-84661
PTL 2 Japanese Patent No. 3852354

However, in multifunction printers and printers, which have been requested to perform continuous, high-speed printing for a long time, as they have been increasing in functionality, another issue has arose in that the interior of a copier or printer may be contaminated when an existing toner is used for continuous printing.

In addition, there has been a shift to use a resin capable of low-temperature fixing as the binder resin used for toner from the viewpoint of energy saving. Consequently, wax contained in toner particles may excessively bleed to the surfaces of the toner particles compared with an existing toner, which may lead to occurrence of image defects.

Accordingly, a toner capable of producing good toner images for a long period of time while maintaining a broad fixable range and capable of reducing interior contamination in long-term use is desired.

An object of the present invention is to provide a toner capable of producing good toner images for a long period of time while maintaining a broad fixing temperature range and capable of reducing interior contamination in long-term use.

SUMMARY OF INVENTION

The inventors of the present invention have conducted extensive studies and consequently found that the object can be achieved by producing a toner that includes the following components. Thus, the present invention has made.

Specifically, the present invention relates to a toner that includes toner particles, each of which contains a binder resin, a colorant, and a wax. The toner has a softening point of 75° C. or more and 110° C. or less measured by a constant-pressure-extrusion-type capillary rheometer. The wax is a hydrocarbon wax composed of a hydrocarbon compound. In a carbon number distribution chart, which is drawn based on analytical values obtained by gas chromatography and shows carbon number on the abscissa and abundance ratio (area %) of the hydrocarbon compound on the ordinate, (i) a carbon number of a hydrocarbon compound that has the maximum abundance ratio is 40 or more and 45 or less and an abundance ratio of the hydrocarbon compound that has the carbon number at the maximum abundance ratio is 6.5 area % or more and 9.0 area % or less, (ii) a total sum of abundance ratios of hydrocarbon compounds that have a carbon number of 33 or less is 4.0 area % or less, (iii) a total sum of abundance ratios of hydrocarbon compounds that have a carbon number of 34 or more and 38 or less is 12.0 area % or more and 25.0 area % or less, and (iv) a total sum of abundance ratios of hydrocarbon compounds that have a carbon number of 50 or more is 5.0 area % or more and 15.0 area % or less.

Further features of the present invention will become apparent from the following description of exemplary embodiments with reference to the attached drawings.

DESCRIPTION OF EMBODIMENTS

Figure 1:
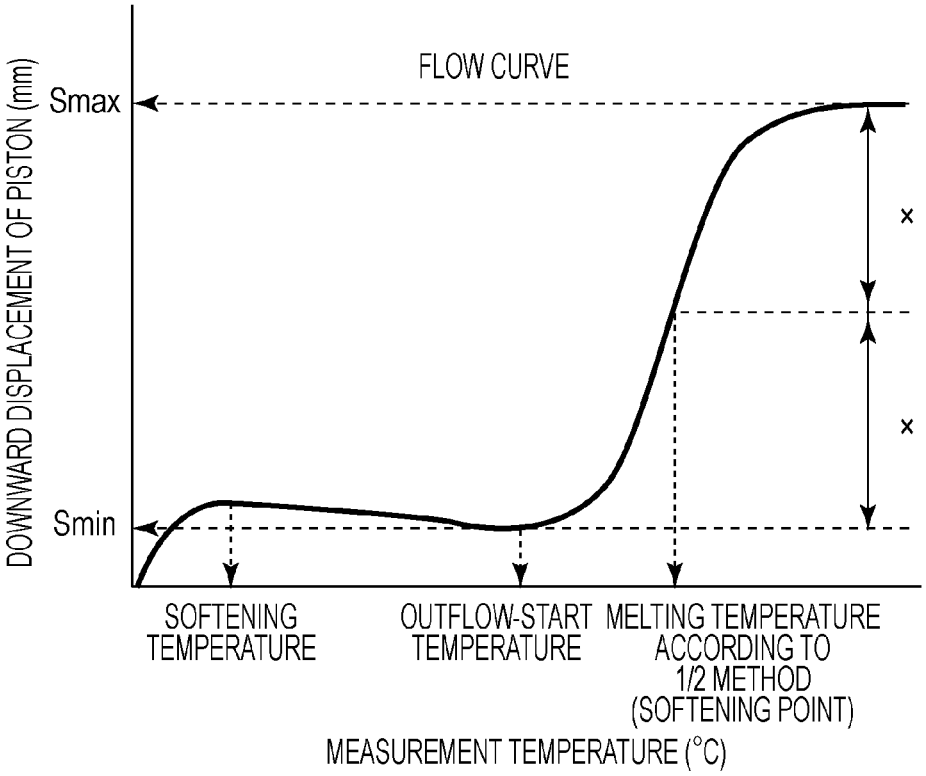
FIG. 1 is a schematic diagram of a flow curve of a toner obtained with a constant-pressure-extrusion-type capillary rheometer.

The embodiments of the present invention will be specifically described below.

A toner according to the present invention includes toner particles, each of which contains a binder resin, a colorant, and a wax. The toner has a softening point of 75° C. or more and 110° C. or less measured by a constant-pressure-extrusion-type capillary rheometer. The wax is a hydrocarbon wax composed of a hydrocarbon compound. In a carbon number distribution chart showing carbon number on an abscissa and abundance ratio (area %) of the hydrocarbon compound on an ordinate, the carbon number distribution chart being drawn based on analytical values obtained by analyzing the hydrocarbon wax by gas chromatography, (i) a carbon number showing the maximum abundance ratio is present within a range of 40 or more and 45 or less, and an abundance ratio at the carbon number showing the maximum abundance ratio is 6.5 area % or more, and 9.0 area % or less, (ii) a total sum of abundance ratios in a carbon number range of 33 or less is 4.0 area % or less, (iii) a total sum of abundance ratios in a carbon number range of 34 or more, and 38 or less, is 12.0 area % or more and 25.0 area % or less, and (iv) a total sum of abundance ratios in a carbon number range of 50 or more is 5.0 area % or more and 15.0 area % or less.

In the carbon number distribution chart, abundance ratio at each carbon number refers to the abundance ratio of a hydrocarbon compound that has that carbon number.

An example of a method for saving energy in an image forming apparatus is to lower the temperature of a fixing member. In this case, the low-temperature fixability of toner needs to be further improved. In order to improve the low-temperature fixability of toner, for example, it is essential to set the softening point of toner to be lower. The softening point of toner needs to be set to 75° C. or more and 110° C. or less in order to achieve low-temperature fixability, durability, and blocking resistance in a balanced manner because an excessively low softening point of toner degrades the durability and blocking resistance of toner.

It was found that interior contamination with wax is likely to occur and image defects are likely to occur due to excessive bleeding of wax to the surfaces of toner particles when the softening point of the binder resin of a toner is lowered in order to lower the softening point of the toner.

The inventors of the present invention have focused on the behavior of the wax and conducted studies thereon. As a result, they have found that a wax is prevented from excessively bleeding to the surfaces of the toner particles when the wax has specific abundance ratios of hydrocarbon compounds as specified in the present invention and thus good toner images can be formed over a long period of time.

In addition, it has been found that interior contamination of an image forming apparatus, such as contamination of fixing unit or members peripheral thereto, can be suppressed even in long-term use.

Specifically, wax is melted when heat is supplied to toner in a fixing process and thereby allowed to move in binder resin, thus contributing to promoting the plasticization of the binder resin and to preventing the toner from adhering to a fixing member by bleeding to the surfaces of the toner particles.

The hydrocarbon wax used in the present invention is composed of hydrocarbon compounds. Among the hydrocarbon compounds, a hydrocarbon compound that has a high carbon number contributes to improving the releasability by bleeding to the surfaces of the toner particles when the toner is melted and thereby preventing the toner from adhering to the fixing member. In particular, good releasability is produced when the total sum of abundance ratios of hydrocarbon compounds having a carbon number of 50 or more in the wax is 5.0 area % or more and 15.0 area % or less. The releasability is degraded when the total sum of abundance ratios of the hydrocarbon compounds having a carbon number of 50 or more is less than 5.0 area %. When the total sum of abundance ratios of the hydrocarbon compounds having a carbon number of 50 or more is more than 15.0 area %, the low-temperature fixability is degraded because a larger amount of heat is needed to melt hydrocarbon compounds having a high carbon number when performing fixing.

A hydrocarbon compound that has a low carbon number permeates between molecular chains of the binder resin when being melted, thus contributing to improving the plasticity of the binder resin. However, the inventors of the present invention have found that the hydrocarbon compound that has a low carbon number has a role in the interior contamination of an image forming apparatus such as a multifunction printer or a printer.

In the studies conducted by the inventors, it was found that, when continuous printing is performed while an excessive amount of heat is being applied to the toner, some of the constituents of the wax volatize inside the image forming apparatus and the concentration thereof in the interior of the apparatus is increased. The volatilized constituents are cooled as a result of coming into contact with the component members inside the image forming apparatus, and deposited, which may cause the interior contamination. The volatile constituents were analyzed and consequently found to have hydrocarbon compounds having a carbon number of 33 or less as main components. Thus, the occurrence of the interior contamination can be suppressed by setting the total sum of abundance ratios of the hydrocarbon compounds having a carbon number of 33 or less in the wax to be 4.0 area % or less.

It is possible to improve the plasticity of the binder resin while suppressing the interior contamination by setting the total sum of abundance ratios of hydrocarbon compounds having a carbon number of 34 or more and 38 or less to be 12.0 area % or more and 25.0 area % or less. If the total sum of abundance ratios of the hydrocarbon compounds having a carbon number of 34 or more and 38 or less is less than 12.0 area %, the contribution of wax to the plasticity of the binder resin is small, which results in degradation of the low-temperature fixability of the toner. If the total sum of abundance ratios of the hydrocarbon compounds having a carbon number of 34 or more and 38 or less is more than 25.0 area %, the wax may excessively bleed to the surfaces of the toner particles. As a result, image defects such as development streaks and fogging easily occur. In addition, the interior contamination easily occurs.

Considering the above facts, in order to obtain the thermal durability and fixing properties of the toner, it is necessary that a hydrocarbon compound that has the maximum abundance ratio in the wax has a carbon number of 40 or more and 45 or less and the hydrocarbon compound that has the carbon number showing the maximum abundance ratio in the wax has an abundance ratio of 6.5 area % or more and 9.0 area % or less. If the carbon number showing the maximum abundance ratio is less than 40, or the hydrocarbon compound having the carbon number showing the maximum abundance ratio in the wax has an abundance ratio of less than 6.5 area %, the melting point of the wax is lowered, which degrades the durability of the toner. If the carbon number showing the maximum abundance ratio is more than 45, or the hydrocarbon compound having the carbon number showing the maximum abundance ratio in the wax has an abundance ratio of more than 9.0 area %, the melting point of the wax is increased and the wax is not well distributed in the toner particles, which reduces the contribution of the wax to improving the plasticity of the binder resin.

In other word, as shown by the specification where the maximum abundance ratio is 9.0 area % at a maximum, the wax specified in the present invention differs from a wax that contains constituents with a specific carbon number in large amounts. The wax specified in the present invention contains constituents with a carbon number of 33 or less in trace amounts and constituents with carbon numbers in a broad range of 34 to about 50 or more in relatively small amounts.

In order to broaden the fixing temperature range of the toner, it is essential that the carbon numbers in the wax vary to some extent. It is possible to suppress the excessive bleeding of the wax to the surfaces of toner particles and to obtain high-quality images for long printing runs while maintaining the broad fixing temperature range by producing a toner containing a wax having the carbon-number distribution specified in the present invention. In addition, it was found that the wax is effective to reduce the interior contamination of an image forming apparatus such as a multifunction printer or a printer in long printing runs. Thus, the present invention was made.

The plasticity of the binder resin is preferably improved when the total sum of abundance ratios of hydrocarbon compounds that have a carbon number of 34 or more and 36 or less in the wax is 5.0 area % or more and 10.0 area % or less.

The interior contamination of image forming apparatus can be preferably suppressed when the total sum of abundance ratios of hydrocarbon compounds that have a carbon number of 30 or less in the wax is 1.0 area % or less.

As described above, in the present invention, it is essential to control each abundance ratio of hydrocarbon compound that constitutes the hydrocarbon wax to be in an appropriate range. A method for controlling the abundance ratios of the hydrocarbon compounds that constitute the hydrocarbon wax is not particularly limited but preferably includes performing thin-film distillation of the wax. In thin-film distillation, distillation can be performed at a lower temperature for a shorter time than in vacuum distillation. Therefore, generation of hydrocarbon compounds having low carbon numbers produced due to thermal decomposition of hydrocarbon compounds having high carbon numbers can be suppressed. As a result, the hydrocarbon compounds having low carbon numbers in the wax can be efficiently removed.

In the present invention, the content of the hydrocarbon wax in the toner is preferably 3.0 parts by mass or more and 15.0 parts by mass or less, more preferably 4.0 parts by mass or more and 14.0 parts by mass or less, and further preferably 5.0 parts by mass or more and 13.0 parts by mass or less relative to 100.0 parts by mass of the binder resin. It is possible to produce good toner images for a long period of time while maintaining a broad fixing temperature range when the content of the wax is 3.0 parts by mass or more and 15.0 parts by mass or less relative to 100.0 parts by mass of the binder resin.

Examples of the hydrocarbon wax used in the present invention include a paraffin wax, a polyolefin wax, a microcrystalline wax, Fischer-Tropsch wax, a polyethylene wax, a polypropylene wax, and derivatives thereof. Among these waxes, a straight-chain aliphatic hydrocarbon wax composed of a straight-chain aliphatic hydrocarbon compound is preferable.

The toner according to the present invention preferably has a storage modulus G'(70) of $5.0\times10^4$ Pa or more and $1.0\times10^6$ Pa or less at a temperature of 70° C. and a loss modulus G"(70) of $2.0\times10^4$ Pa or more and $1.0\times10^7$ Pa or less at a temperature of 70° C. in dynamic viscoelasticity measurement. When the storage modulus G'(70) and loss modulus G"(70) of the toner at a temperature of 70° C. fall within the respective ranges described above, the elasticity and viscosity of the binder resin are balanced and the low-temperature fixability is improved while suppressing occurrence of excessive bleeding of the wax.

The toner according to the present invention preferably has a storage modulus G'(160) of $1.0\times10^2$ Pa or more and $1.0\times10^3$ Pa or less at a temperature of 160° C. and a loss modulus G"(160) of $2.0\times10^2$ Pa or more and $1.0\times10^3$ Pa or less at a temperature of 160° C. in dynamic viscoelasticity measurement. When the storage modulus G'(160) and loss modulus G"(160) of the toner at a temperature of 160° C. fall within the respective ranges described above, it is possible to impart high glossiness to a toner image after fixing and to improve high-temperature offset resistance.

The method for producing the toner according to the present invention is not limited but preferably a method for producing the toner is a method including granulating a polymerizable monomer composition in an aqueous medium, such as a suspension polymerization method, an emulsion polymerization method, or a suspension granulating method. Hereafter, the production method of the toner is described with reference to the suspension polymerization method, which is the most preferable production method of a toner among those used in the present invention.

Specifically, the suspension polymerization method includes (a) a granulating step of dispersing a polymerizable monomer composition that contains a polymerizable monomer, the colorant, and the wax in an aqueous medium to form droplets of the polymerizable monomer composition, and (b) a polymerizing step of polymerizing the polymerizable monomer in the droplets to produce toner particles.

The wax, the binder resin, and a colorant that satisfy the physical properties specified in the present invention and other additives that are included as necessary are dissolved or dispersed homogeneously with a disperser such as a homogenizer, a ball mill, a colloid mill, or an ultrasonic disperser. Then, a polymerization initiator is dissolved in the resulting solution or dispersion to prepare a polymerizable monomer composition. The polymerizable monomer composition is suspended into an aqueous medium that contains a dispersion stabilizer and polymerized to produce toner particles.

The polymerization initiator may be added at the same time as the other additives are added to the polymerizable monomer or immediately before the polymerizable monomer composition is suspended into the aqueous medium. Alternatively, immediately after granulation and before starting the polymerization reaction, a polymerization initiator dissolved in the polymerizable monomer or the solvent may be added.

Binder resins such as those generally used can be used as the binder resin of the toner. Specific examples thereof include styrene-acrylic copolymers, styrene-methacrylic copolymers, epoxy resins, and styrene-butadiene copolymers. Polymerizable vinyl monomers that undergo radical polymerization can be used as the polymerizable monomer. Examples of the polymerizable vinyl monomers include monofunctional polymerizable monomers and polyfunctional polymerizable monomers.

Examples of the monofunctional polymerizable monomers include styrene and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate;

methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate;

vinyl esters such as methylene aliphatic monocarboxylic acid esters, vinyl acetate, vinyl propionate, vinyl butyrate, vinyl benzoate, and vinyl formate; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone.

Examples of the polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

The monofunctional polymerizable monomers may be used alone or in combination of two or more. Alternatively, the monofunctional polymerizable monomers and polyfunctional polymerizable monomers may be used in combination. Alternatively, the polyfunctional polymerizable monomers may be used alone or in combination of two or more. From the viewpoint of the developing properties and durability of the toner, among these polymerizable monomers, styrene and styrene derivatives are preferably used alone, in a mixture with each other, or in a mixture with another polymerizable monomer.

A polar resin is preferably added to the liquid mixture described above in a polymerization method using an aqueous medium, such as the suspension polymerization method. Addition of the polar resin promotes inclusion of the wax.

When the polar resin is present in a dispersion prepared by suspending a colorant in an aqueous medium, the polar resin is likely to move to the interface between the aqueous medium and the colorant dispersion due to the difference in affinity to water, which results in localization of the polar resin on the surfaces of the toner particles. As a result, the toner particles come to have a core-shell structure.

When a polar resin that has a high melting temperature is selected as the polar resin used as the shell, the occurrence of blocking during storage of the toner can be suppressed even in the case where the toner is designed so that the binder resin can be melted at a lower temperature in order to achieve low-temperature fixing.

A saturated or unsaturated polyester resin is preferable as the polar resin. In the case where a saturated or unsaturated polyester resin is used as the polar resin, the lubricity of the resin can be expected when the resin localizes on the surfaces of the toner particles to form the shells. In addition, excessive triboelectrification in a low-temperature, low-humidity environment can be suppressed because the usage of the polar resin permits an appropriate amount of nonionic surfactant to be present on the surfaces of the toner particles.

The polyester resin used can be produced by polycondensation of an acid-component monomer with an alcohol-component monomer described below. Examples of the acid-component monomer include terephthalic acid, isophthalic acid, phthalic acid, fumaric acid, maleic acid, malonic acid, succinic acid, glutaric acid, adipic acid, pimelic acid, suberic acid, azelaic acid, sebacic acid, camphoric acid, cyclohexanedicarboxylic acid, and trimellitic acid.

Examples of the alcohol-component monomer include alkylene glycols such as ethylene glycol, diethylene glycol, triethylene glycol, 1,2-propylene glycol, 1,3-propylene glycol, 1,4-butanediol, neopentyl glycol, and 1,4-bis(hydroxymethyl)cyclohexane, polyalkylene glycols thereof, bisphenol A, hydrogenated bisphenol, ethylene oxide adducts on bisphenol A, propylene oxide adducts on bisphenol A, glycerol, trimethylolpropane, and pentaerythritol.

The content of the polar resin is preferably 1.0 parts by mass or more and 20.0 parts by mass or less and more preferably 2.0 parts by mass or more and 10.0 parts by mass or less relative to 100.0 parts by mass of the polymerizable monomer.

Examples of the colorant used in the present invention include the following organic pigments, organic dyes, and inorganic pigments.

Examples of a cyan colorant include copper phthalocyanine compounds and derivatives thereof, anthraquinone compounds, and basic dye lake compounds. Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, and C.I. Pigment Blue 62.

Examples of a magenta colorant include condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples thereof include C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

Examples of a yellow colorant include condensed azo compounds, isoindolinone compounds, anthraquinone compounds, azo metal complexes, methine compounds, and allylamide compounds. Specific examples thereof include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 185, C.I. Pigment Yellow 191, and C.I. Pigment Yellow 194.

Examples of a black colorant include carbon black and black colorants produced by toning using the above-described yellow colorants, magenta colorants, and cyan colorants.

These colorants may be used alone or in a mixture, and may be used in the form of a solid solution. The colorant used in the present invention is selected in accordance with hue angle, chroma, lightness, lightfastness, OHP transparency, and dispersibility in the toner particles.

The amount of the colorant is preferably 1.0 to 20.0 parts by mass relative to 100.0 parts by mass of the binder resin. Caution must be taken regarding the polymerization inhibiting property and aqueous-phase-transition property of the colorant when the suspension polymerization method is employed to produce the toner particles. Accordingly, it is preferable to use colorants hydrophobized with a substance that does not cause polymerization inhibitation. Particular caution must be taken when a dye or carbon black is used because it often has a polymerization inhibiting property. A preferred method for hydrophobizing the dye includes, for example, polymerizing a polymerizable monomer in the presence of a dye in advance and thereby producing a colored polymer. The resulting colored polymer is then added to the polymerizable monomer composition. The carbon black may be hydrophobized in a similar manner to the dye. Alternatively, the carbon black may be hydrophobized with a substance (such as polyorganosiloxane) that reacts with surface functional groups of the carbon black.

A charge-controlling agent may be added if needed. Any publicly known charge-controlling agent can be used as the charge-controlling agent. A charge-controlling agent that has a high triboelectrification rate and maintains a certain amount of triboelectrification stably is particularly preferable. In the case where the suspension polymerization method is employed to produce toner particles, it is preferable to use a charge-controlling agent that has a low polymerization inhibiting property and substantially no aqueous-medium-soluble substances. Examples of such charge-controlling agents include charge-controlling agents that control a toner to be negatively chargeable and charge-controlling agents that control a toner to be positively chargeable. Examples of charge-controlling agents that control a toner to be negatively chargeable include monoazo-metal compounds, acetylacetone metal compounds, aromatic oxycarboxylic acids, aromatic dicarboxylic acids, metal compounds based on hydroxycarboxylic acids and dicarboxylic acids, aromatic hydroxycarboxylic acids, aromatic mono- and poly-carboxylic acids and their metal salts, anhydrides, and esters, phenol derivatives such as bisphenol, urea derivatives, metal-containing salicylic compounds, metal-containing naphthoic compounds, boron compounds, quaternary ammonium salts, calixarene, and charge-controlling resins.

Examples of charge-controlling agents that control a toner to be positively chargeable include guanidine compounds; imidazole compounds; quaternary ammonium salts such as tributylbenzylammonium-1-hydroxy-4-naphthosulfonate salts and tetrabutylammonium tetrafluoroborate, and onium salts that are the analogues of the quaternary ammonium salts, such as the phosphonium salts, and their lake pigments; triphenylmethane dyes and their lake pigments (examples of laking agents include phosphotungstic acid, phosphomolybdic acid, phosphotungstomolybdic acid, tannic acid, lauric acid, gallic acid, ferricyanide, and ferrocyanide); the metal salts of higher fatty acids; charge controlling resins.

The charge-controlling agents may be added alone or in combination of two or more. Among these charge-controlling agents, metal-containing salicylic compounds are preferable, it being particularly preferably that the metal be aluminum or zirconium.

The amount of charge-controlling agent added is preferably 0.01 to 20.0 parts by mass and more preferably 0.5 to 10.0 parts by mass relative to 100.0 parts by mass of the binder resin.

The charge controlling resin is preferably a polymer or copolymer that has a sulfonic acid group, a sulfonate group, or a sulfonate ester group. In particular, the polymer that has a sulfonic acid group, a sulfonate group, or a sulfonate ester group preferably contains a sulfonic-acid-group-containing acrylamide monomer or a sulfonic-acid-group-containing methacrylamide monomer in an amount of 2% by mass or more, preferably 5% by mass or more in terms of copolymerization ratio. The charge controlling resin preferably has a glass transition temperature (Tg) of 35° C. to 90° C., a peak molecular weight (Mp) of 10,000 to 30,000, and a weight-average molecular weight (Mn) of 25,000 to 50,000. When such a charge controlling resin is used, a favorable triboelectrification property can be imparted without impairing the heat properties required for the toner particles. Moreover, the dispersibility of the charge controlling resin in the dispersion containing the colorant and the dispersibility of the colorant are improved due to the sulfonic acid group of the charge controlling resin, which can further improve tinting strength, transparency, and the triboelectrification property.

A polymerization initiator may be used to cause polymerization of the polymerizable monomer. Examples of the polymerization initiator that can be used in the present invention include organic peroxide-based initiators and azo-based polymerization initiators. Examples of the organic peroxide-based initiators include benzoyl peroxide, lauroyl peroxide, di-α-cumyl peroxide, 2,5-dimethyl-2,5-bis(benzoylperoxy) hexane, bis(4-t-butylcyclohexyl)peroxydicarbonate, 1,1-bis (t-butylperoxy)cyclododecane, t-butylperoxymaleic acid, bis (t-butylperoxy)isophthalate, methyl ethyl ketone peroxide, tert-butylperoxy-2-ethylhexanoate, diisopropyl peroxycarbonate, cumene hydroperoxide, 2,4-dichlorobenzoyl peroxide, and tert-butyl-peroxypivalate.

Examples of the azo-based polymerization initiators include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobismethyl butyronitrile.

A redox initiator that contains an oxidizing substance and a reducing substance in combination can also be used as the polymerization initiator. Examples of the oxidizing substance include inorganic peroxides such as hydrogen peroxide and persulfates (sodium salt, potassium salt, and ammonium salt) and oxidizing metal salts such as tetravalent cerium salts. Examples of the reducing substance include reducing metal salts (divalent iron salts, monovalent copper salts, and trivalent chromium salts); ammonia; amino compounds such as lower amines (amines with a carbon number of about 1 to 6, such as methylamine and ethylamine) and hydroxylamine; reducing sulfur compounds such as sodium thiosulfate, sodium hydrosulfite, sodium bisulfite, sodium sulfite, and sodium formaldehyde sulfoxylate; lower alcohols (carbon number: 1 to 6); ascorbic acid and its salts; and lower aldehydes (carbon number: 1 to 6).

The polymerization initiator is selected based on the 10-hour half-life temperature thereof, and used alone or in a mixture. The amount of the polymerization initiator added changes depending on the intended degree of polymerization, and is generally 0.5 parts by mass or more and 20.0 parts by mass or less relative to 100.0 parts by mass of the polymerizable monomer.

A known chain transfer agent and polymerization inhibitor may be further added to control the degree of polymerization.

Various crosslinking agents can also be used for the polymerization of the polymerizable monomer. Examples of the crosslinking agents include polyfunctional compounds such as divinylbenzene, 4,4'-divinylbiphenyl, ethylene glycol diacrylate, ethylene glycol dimethacrylate, diethylene glycol diacrylate, diethylene glycol dimethacrylate, glycidyl acrylate, glycidyl methacrylate, trimethylolpropane triacrylate, and trimethylolpropane trimethacrylate.

Known dispersion stabilizers composed of an inorganic compound or composed of an organic compound can be used as the dispersion stabilizer used for preparing the aqueous medium. Examples of the dispersion stabilizers composed of an inorganic compound include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the dispersion stabilizers composed of an inorganic compound include polyvinyl alcohol, gelatin, methyl cellulose, methyl hydroxypropyl cellulose, ethyl cellulose, the sodium salt of carboxymethyl cellulose, polyacrylic acid and its salts, and starch. The amount of the dispersion stabilizer used is preferably 0.2 parts by mass or more and 20.0 parts by mass or less relative to 100.0 parts by mass of the polymerizable monomer.

When the dispersion stabilizer composed of an inorganic compound is employed among these dispersion stabilizers, a commercially available one may be directly used. Alternatively, the inorganic compound may be produced in an aqueous medium in order to obtain a dispersion stabilizer with a small particle size. For example, tricalcium phosphate can be produced by mixing an aqueous sodium phosphate solution with an aqueous calcium chloride solution while performing vigorous stirring.

An external additive may be added externally to the toner particles in order to impart various properties to the toner. Examples of the external additive for improving the toner fluidity include inorganic fine powders such as silica fine powder, titanium oxide fine powder, and their double oxide fine powders thereof. Among the inorganic fine powders, silica fine powder and titanium oxide fine powder are preferable.

Examples of the silica fine powder include fumed silica and dry silica produced by vapor-phase oxidation of a silicon halide and wet silica produced from water glass. The inorganic fine powder is preferably dry silica that contains a small amount of silanol groups on the surface and in the interior of the silica fine powder and small amounts of $Na_2O$ and $SO_3^{2-}$. The dry silica may also be a composite fine powder of silica with another metal oxide, which is produced by using another metal halide compound such as aluminum chloride or titanium chloride with the silicon halide compound in the production process.

The inorganic fine powder is preferably hydrophobized because the amount of triboelectrification of the toner can be controlled, the environmental stability of the toner can be improved, and the fluidity of the toner in a high-humidity environment can be improved when the surface of the inorganic fine powder is hydrophobized with a treatment agent. If the inorganic fine powder externally added to the toner absorbs moisture, the amount of triboelectrification and the fluidity of the toner are degraded, which is likely to result in degradation of the developing properties and transfer properties.

Examples of the treatment agent for hydrophobizing the inorganic fine powder include unmodified silicone varnishes, various modified silicone varnishes, unmodified silicone oils, various modified silicone oils, silane compounds, silane coupling agents, other organosilicon compounds, and organotitanium compounds. Among these, a silicone oil is preferable. These treatment agents may be used alone or in combination.

The total amount of inorganic fine powder added is preferably 1.0 to 5.0 parts by mass and more preferably 1.0 to 2.5 parts by mass relative to 100.0 parts by mass of the toner particles. The external additives preferably have a particle size of 1/10 or less the average particle size of the toner particles from the viewpoint of durability when added to the toner.

Hereafter, methods for determining various physical properties according to the present invention will be described.

Method for Determining Carbon Number Distribution of Wax

The carbon number distribution of a wax is determined by gas chromatography (GC) as follows: 10 mg of the wax is accurately weighed and placed into a sample bottle. Into the sample bottle, 10 g of accurately weighed hexane is added. The sample bottle is sealed and then heated to a temperature of 150° C. with a hot plate. Then, the sample is mixed, immediately injected into a gas chromatograph injection port so that the wax does not precipitate, and analyzed to produce a chart showing carbon number on the abscissa and signal intensity on the ordinate. Using the chart, for each carbon number, the area percentage of a peak that corresponds to each carbon number relative to the total of the areas of all detected peaks is calculated as an abundance ratio (area %) of each hydrocarbon compound. Then, a carbon number distribution chart is drawn with the carbon numbers on the abscissa and the abundance ratios (area %) of hydrocarbon compounds on the ordinate. The measurement instruments and conditions are as follows:

GC: Hewlett-Packard Development Company, L.P. 6890GC

Column: ULTRA ALLOY-1P/N: UA1-30m-0.5F (produced by Frontier Laboratories Ltd.)

Carrier gas: He

Oven: (1) Holding at a temperature of 100° C. for 5 minutes, (2) Heating to a temperature of 360° C. at 30° C./min, and (3) Holding at a temperature of 360° C. for 60 minutes Injection port: A temperature of 300° C.

Initial pressure: 10.523 psi

Split ratio: 50:1

Column flow rate: 1 mL/min

Method for Measuring Softening Point of Toner

The softening point of the toner is measured with a constant-pressure-extrusion-type capillary rheometer "Rheological properties evaluation instrument, Flowtester CFT- 500D" (produced by Shimadzu Corporation) in accordance with the manual attached to the instrument. In this instrument, a measurement sample filled in a cylinder is heated while applying a constant pressure to the upper surface of the measurement sample with a piston so as to melt the sample, and the melted measurement sample is extruded from a die disposed at the bottom of the cylinder. Thus, a flow curve that shows a relationship between downward displacement of the piston and temperature measured as above can be drawn. In the present invention, the softening point is considered to correspond to "melting temperature in the ½ method" described in the manual attached to "Rheological properties evaluation instrument, Flowtester CFT-500D". The melting temperature in the ½ method is determined as follows: First, ½ of difference between the downward displacement of the piston at the end of outflow Smax and at the start of outflow 5 min is calculated (this is represented by X: X={(Smax−5 min)/2}). The melting temperature in the ½ method is determined as a temperature in the flow curve at which the downward displacement of the piston is equal to the sum of X and Smin (FIG. 1 shows a schematic diagram of a flow curve). The measurement sample used is prepared by compression-molding about 1.0 g of toner using a tablet-forming compression apparatus (e.g., NT-100H, produced by NPa SYSTEM CO., LTD.) at about 10 MPa for about 60 seconds at 25° C. to form the toner into a cylindrical shape having a diameter of about 8 mm. The measurement conditions of CFT-500D are as follows:

Testing mode: Heating method
Start temperature: 50° C.
Target temperature: 200° C.
Measurement interval: 1.0° C.
Heating rate: 4.0° C./min
Piston cross-sectional area: 1.000 $cm^2$
Test load (piston load): 10.0 kgf (0.9807 MPa)
Preheating time: 300 seconds
Die hole diameter: 1.0 mm
Die length: 1.0 mm Method for Measuring Dynamic Viscoelasticity of Toner The measurement was conducted using a viscoelasticity measuring instrument (rheometer) ARES (produced by Rheometric Scientific, Inc.) in accordance with the ARES operation manual 902-30004 (1997 August edition), 902-00153 (1993 July edition) published by Rheometric Scientific, Inc.

Measurement jig: A 7.9 mm diameter serrated parallel plate is used.

Measurement sample: Toner particles are molded with a pressure molding machine to form a cylindrical sample with a diameter of about 8 mm and a height of about 2 mm (maintaining 15 kN for 1 minute at a room temperature). The pressure molding machine is an 100 kN-press NT-100H produced by NPa SYSTEM CO., LTD.

The temperature of the serrated parallel plate is controlled to be 90° C. The cylindrical sample is heated and melted so that a serrate is inserted thereinto, and then firmly fixed to the serrated parallel plate by applying a vertical load so that the axial force does not exceed 30 (g weight). A steel belt may be used in order to adjust the diameter of the sample to be equal to that of the parallel plate. The serrated parallel plate and the cylindrical sample are slowly cooled to the measurement start temperature of 30.00° C. over 1 hour.

Measurement frequency: 6.28 rad/sec

Setting for measurement distortion: measurement is conducted by setting an initial value to 0.1% in an automatic measurement mode.

Sample elongation adjustment: Automatic measurement mode

Measurement temperature: From 30° C. to 150° C. at a heating rate of 2° C. per minute Measurement interval: Viscoelasticity data is measured every 30 seconds, i.e., every 1° C.

Data is transferred to an RSI Orchestrator (software for control, data collection, and data analysis, produced by Rheometric Scientific, Inc.), which operates under Windows (registered trademark) 2000 produced by Microsoft Corporation, via an interface. Then, storage modulus G' and loss modulus G" at 70° C. are obtained based on the analyzed data and defined as G'(70) and G"(70), respectively. In a similar manner, storage modulus G' and loss modulus G" at 160° C. are obtained and defined as G'(160) and G"(160), respectively.

EXAMPLES

The present invention will now be described specifically by Examples, which do not limit the scope of the present invention. The "part" and "%" in Examples and Comparative Examples are on a mass basis unless otherwise noted.

Waxes used in Examples will now be described.

Preparation of Wax 1

Figure 2:
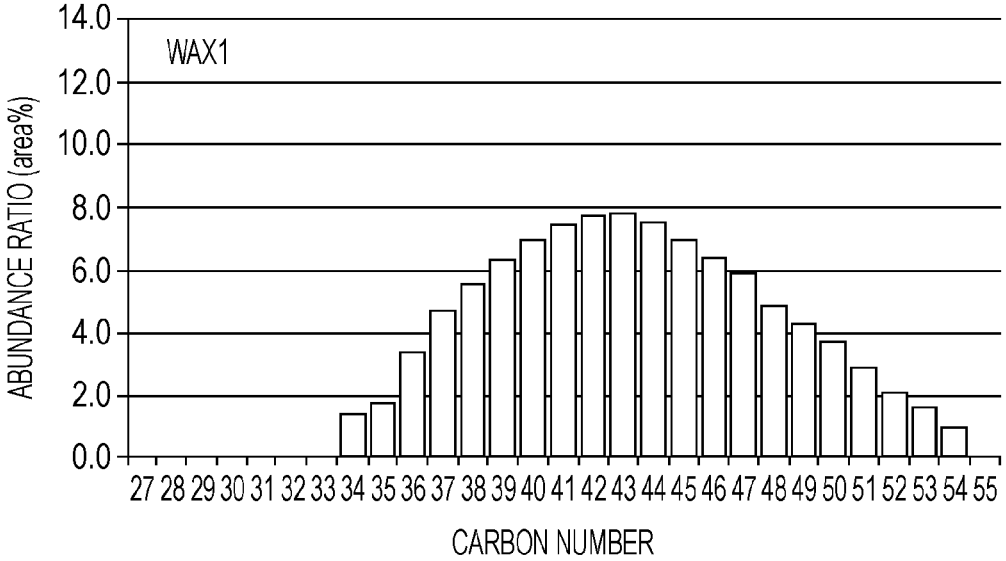
FIG. 2 is a carbon number distribution chart of wax 1.

Sasol C80 (produced by Sasol Ltd.), which is a Fischer-Tropsch wax, was used as a raw material, and subjected to thin-film distillation at a temperature of 250° C. and a pressure of 0.1 Torr to prepare wax 1. Table 2 shows the physical properties of the wax 1. FIG. 2 shows a carbon number distribution chart of the wax 1. In thin-film distillation, a condensation plane is relatively positioned at a position nearer to an evaporation plane than in usual vacuum distillation, which reduces a pressure loss caused by evaporation of the sample. Thus, distillation can be performed in a middle vacuum region (about 0.1 Torr) with a short residence time (within a few seconds to 1 minute) without excessive heat being applied. As a result, the generation of low carbon number components due to thermal decomposition can be suppressed.

Preparation of Waxes 2, 4, and 6

Waxes 2, 4, and 6 were prepared in the same way as in preparation of wax 1 except that the raw material and the purification conditions of the wax 1 were changed as shown in Table 1. Table 2 shows the physical properties of the waxes 2, 4, and 6. Hi-mic80, which is a microcrystalline wax used as a raw material of the wax 2, is produced by Nippon Seiro Co., Ltd.

Preparation of Wax 3

FT100, which is a Fischer-Tropsch wax (produced by Nippon Seiro Co., Ltd.), was used as a raw material. The raw material was completely dissolved in toluene at 100° C., and cooled to 70° C., and then precipitated high-melting-point constituents were filtered out. The residual solvent was cooled and removed to obtain low-melting-point constituents. The low-melting-point constituents were subjected to thin-film distillation at a temperature of 220° C. and a pressure of 0.5 Torr to prepare wax 3. Table 2 shows the physical properties of the wax 3.

Preparation of Wax 5

A Metallocene PE wax (produced by Mitsui Chemicals, Inc.), which is a polyethylene wax, was used as a raw material. The raw material was completely dissolved in toluene at 100° C., cooled to 80° C., and then precipitated high-melting-point constituents were filtered out. The residual solvent was cooled and removed to obtain low-melting-point constituents. The low-melting-point constituents were subjected to thin-film distillation at a temperature of 255° C. and a pressure of 0.1 Torr to prepare wax 5. Table 2 shows the physical properties of the wax 5.

Preparation of Wax 7

Sasol C80 (produced by Sasol Ltd.), which is a Fischer-Tropsch wax, was used as a raw material, and subjected to vacuum distillation at a temperature of 350° C. and a pressure of 30 Torr to prepare wax 7. Table 2 shows the physical properties of the wax 7.

Wax 8

Figure 3:
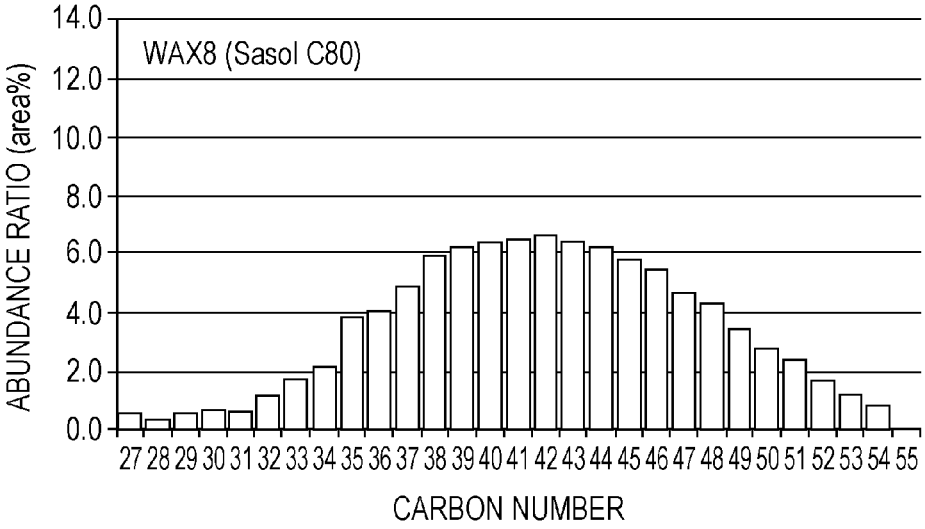
FIG. 3 is a carbon number distribution chart of wax 8 (Sasol C80).

A Fischer-Tropsch wax (Sasol C80, produced by Sasol Ltd.) was used as wax 8. Table 2 shows the physical properties of the wax 8. FIG. 3 shows a carbon number distribution chart of the wax 8.

Wax 9

Figure 4:
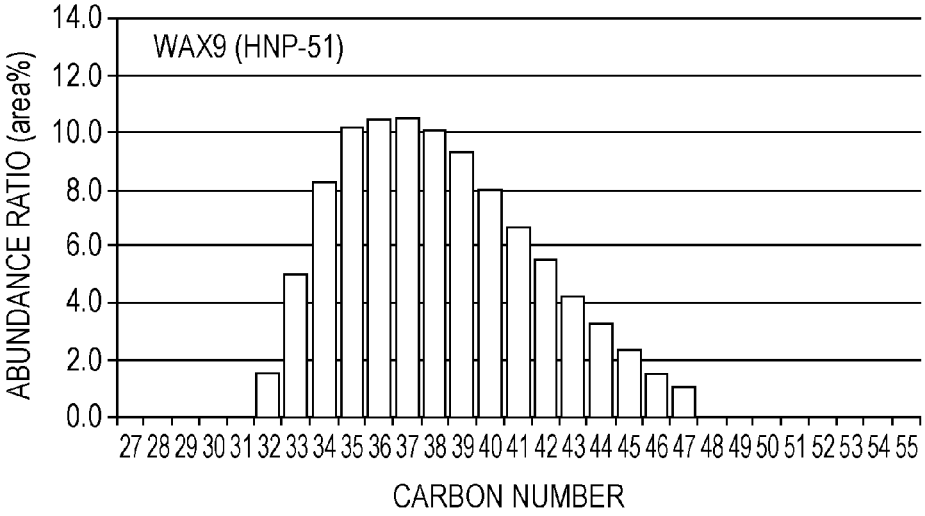
FIG. 4 is a carbon number distribution chart of wax 9 (HNP-51).

HNP-51 (produced by Nippon Seiro Co., Ltd.), which is a paraffin wax, was used as wax 9. Table 2 shows the physical properties of the wax 9. FIG. 4 shows a carbon number distribution chart of the wax 9.

Wax 10

Figure 5:
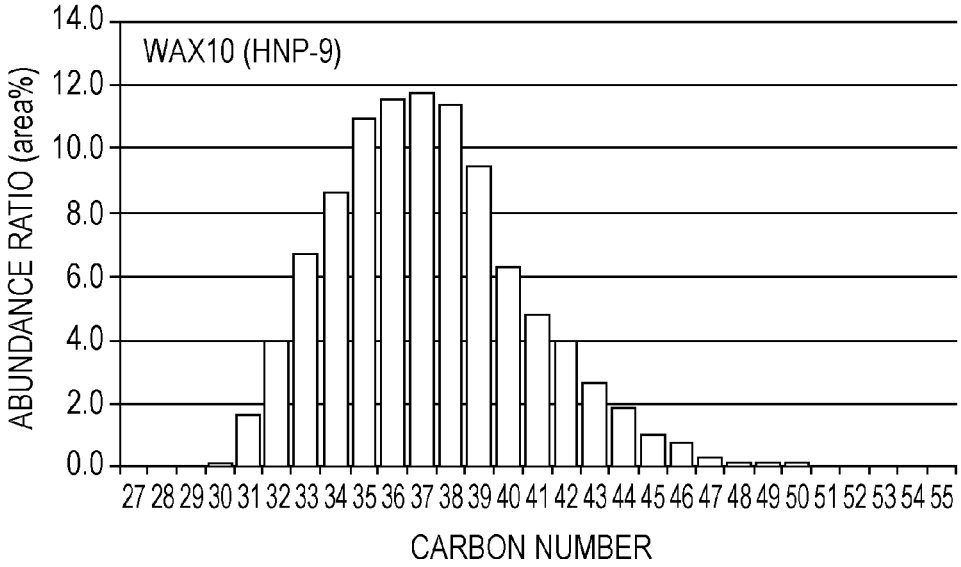
FIG. 5 is a carbon number distribution chart of wax 10 (HNP-9).

HNP-9 (produced by Nippon Seiro Co., Ltd.), which is a paraffin wax, was used as wax 10. Table 2 shows the physical properties of the wax 10. FIG. 5 shows a carbon number distribution chart of the wax 10.

Wax 11

Figure 6:
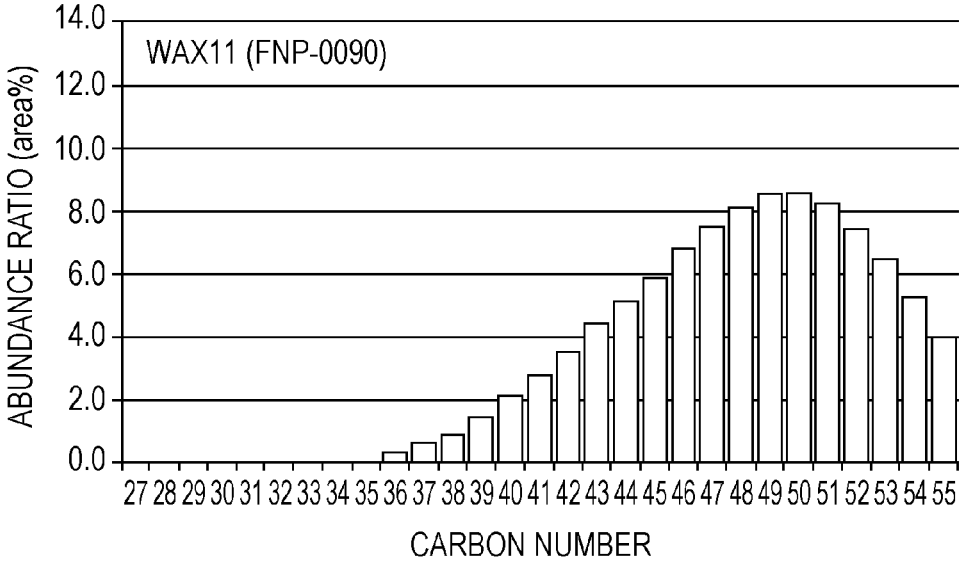
FIG. 6 is a carbon number distribution chart of wax 11 (FNP0090).

FNP0090 (produced by Nippon Seiro Co., Ltd.), which is a Fischer-Tropsch wax, was used as wax 11. Table 2 shows the physical properties of the wax 11. FIG. 6 shows a carbon number distribution chart of the wax 11.

TABLE 1

| | | Purification conditions | | |
|---|---|---|---|---|
| | Raw material | Purification method | Temperature (° C.) | Pressure (Torr) |
| Wax 1 | Sasol C80 | Thin-film distillation | 250 | 0.1 |
| Wax 2 | Hi-mic80 | Thin-film distillation | 255 | 0.1 |
| Wax 3 | FT100 | Fractional crystallization | 70 | — |
| | | Thin-film distillation | 220 | 0.5 |
| Wax 4 | Sasol C80 | Thin-film distillation | 230 | 0.1 |
| Wax 5 | Metallocene | Fractional crystallization | 80 | — |
| | PE wax | Thin-film distillation | 255 | 0.1 |
| Wax 6 | Sasol C80 | Thin-film distillation | 220 | 0.1 |
| Wax 7 | Sasol C80 | Vacuum distillation | 350 | 30 |
| Wax 8 | | Sasol C80 | | |
| Wax 9 | | HNP-51 | | |
| Wax 10 | | HNP-9 | | |
| Wax 11 | | FNP0090 | | |

Preparation of Negatively-Charge-Controlling Resin 1

Into a pressurizable reactor equipped with a reflux tube, a stirrer, a thermometer, a nitrogen-introducing tube, a dropper, and a decompressor, 255.0 parts by mass of methanol, 145.0 parts by mass of 2-butanone, and 100.0 parts by mass of 2-propanol were added as solvents, 88.0 parts by mass of styrene, 6.0 parts by mass of 2-ethylhexyl acrylate, and 5.0 parts by mass of 2-acrylamide-2-methylpropanesulfonic acid were added as polymerizable monomers, and heated to a reflux temperature with stirring. A solution prepared by diluting 1.0 parts by mass of 2,2'-azobisisobutyronitrile, which is a polymerization initiator, with 20.0 parts by mass of 2-butanone was added dropwise over 30 minutes and stirring was continued for further 5 hours. A solution prepared by diluting 1.2 parts by mass of 2,2'-azobisisobutyronitrile with 20 parts by mass of 2-butanone was further added dropwise over 30 minutes and stirring was continued for further 5 hours. Thus, polymerization was terminated to form aggregates.

The aggregates, which were obtained after vacuum-distilling off the polymerization solvent, were coarsely crushed to a size of 100 μm or less with a cutter mill equipped with a screen of 150 mesh (opening: 104 μm) and further pulverized with a jet mill. The pulverized powder was classified using a sieve of 250 mesh (opening: 61 μm) and particles having a size of 60 μm or less were fractionated. The particles were dissolved in methyl ethyl ketone (MEK) so that the concentration of the particles was 10%, and the resulting solution was gradually added to methanol in an amount 20 times the amount of MEK to cause re-precipitation. The precipitates were washed with methanol in an amount half that used for the re-precipitation, and filtered-out particles were vacuum-dried at a temperature of 35° C. for 48 hours.

The vacuum-dried particles were re-dissolved in MEK so that the concentration of the particles was 10%, and the resulting solution was gradually added to n-hexane in an amount 20 times the amount of MEK to cause re-precipitation. The precipitates were washed with n-hexane in an amount half that used for the re-precipitation, and filtered-out particles were vacuum-dried at a temperature of 35° C. for 48 hours. Thus, a polar polymer was prepared. The polar polymer had a glass transition temperature (Tg) of about 83° C., a main peak molecular weight (Mp) of 21,400, a number-average molecular weight (Mn) of 11,100, a weight-average molecular weight (Mw) of 33,200, and an acid value of 14.5 mgKOH/g. The composition determined by $^{1}$H-NMR (EX-400 produced

TABLE 2

| | Physical properties | | | | | | |
|---|---|---|---|---|---|---|---|
| | Hydrocarbon compound having maximum abundance ratio in wax | | Total sum of abundance ratios of hydrocarbon | Total sum of abundance ratios of hydrocarbon | Total sum of abundance ratios of hydrocarbon | Total sum of abundance ratios of hydrocarbon | Total sum of abundance ratios of hydrocarbon |
| | Carbon number | Abundance Ratio (area %) | compounds having carbon number of 33 or less (area %) | compounds having carbon number of 34 or more and 38 or less (area %) | compounds having carbon number of 50 or more (area %) | compounds having carbon number of 34 or more and 36 or less (area %) | compounds having carbon number of 30 or less (area %) |
| Wax 1 | 43 | 8.2 | 0 | 17.5 | 6.7 | 6.8 | 0 |
| Wax 2 | 45 | 7.0 | 0 | 12.4 | 14.5 | 5.2 | 0 |
| Wax 3 | 40 | 8.5 | 3.8 | 24.5 | 5.2 | 9.8 | 0.9 |
| Wax 4 | 40 | 7.6 | 3.1 | 23.8 | 8.2 | 11.1 | 0.7 |
| Wax 5 | 43 | 8.5 | 0 | 14.5 | 7.0 | 4.8 | 0 |
| Wax 6 | 40 | 7.2 | 3.5 | 24.0 | 8.3 | 12.2 | 1.2 |
| Wax 7 | 40 | 7.0 | 5.7 | 24.0 | 8.4 | 11.7 | 2.1 |
| Wax 8 | 42 | 6.7 | 6.3 | 21.3 | 9.4 | 10.4 | 2.5 |
| Wax 9 | 36 | 10.6 | 6.8 | 50.1 | 0 | 29.4 | 0 |
| Wax 10 | 37 | 11.9 | 12.7 | 54.8 | 0.2 | 31.4 | 3.2 |
| Wax 11 | 49 | 8.7 | 0 | 2.1 | 40.6 | 0.4 | 0 |

by JEOL Ltd.: 400 MHz) was styrene/2-ethylhexyl acrylate/2-acrylamide-2-methylpropanesulfonic acid=88.0:6.0:5.0 (mass ratio). The polar polymer was used as negatively-charge-controlling resin 1.

Preparation of Toner 1

Into 1300 parts of ion exchange water heated at a temperature of 60° C., 9 parts of tricalcium phosphate was added, and the mixture was stirred at a rate of 10,000 rpm with a T.K. HOMO MIXER (produced by Tokushu Kika Kogyo Co., Ltd.) to prepare an aqueous medium. The following binder resin materials were mixed while being stirred at a rate of 100 rpm with a propeller type stirrer to prepare a liquid mixture:

| | |
|---|---|
| Styrene | 59.5 parts by mass |
| n-Butyl acrylate | 25.5 parts by mass |
| Low-molecular-weight polystyrene resin (Mw = 3,000, Mn = 1,050, Tg = 55° C.) | 15.0 parts by mass |

Then, into the solution,

| | |
|---|---|
| Cyan colorant (C.I. Pigment Blue 15:3) | 6.5 parts by mass |
| Negatively-charge-controlling agent (BONTRON E-88, produced by Orient Chemical Industries Co., Ltd.) | 0.5 parts by mass |
| Wax 1 | 9.0 parts by mass |
| Negatively-charge-controlling resin 1 | 0.7 parts by mass |
| Polyester resin (polycondensate of terephthalic acid/isophthalic acid/propylene oxide-modified bisphenol A (2 mol adduct)/ethylene oxide-modified bisphenol A (2 mol adduct) = 30:30:30:10 (mass ratio), acid value: 11 mgKOH/g, Tg = 74° C., Mw = 11,000, Mn = 4,000) were added. The liquid mixture was then heated to a temperature of 65° C. and stirred at a rate of 10,000 rpm with a T. K. HOMO MIXER (produced by Tokushu Kika Kogyo Co., Ltd.) to dissolve and disperse these materials. Thus, a polymerizable monomer composition was prepared. | 5.0 parts by mass |

Into the aqueous medium, the polymerizable monomer composition was added and 10.0 parts by mass of perbutyl PV (10-hour half-life temperature: 54.6° C. (produced by NOF Corporation)) was added as a polymerization initiator, and the mixture was stirred at a rate of 10,000 rpm for 20 minutes at a temperature of 70° C. with a T.K. HOMO MIXER to perform granulation.

The granulated product was transferred to a propeller type stirrer and polymerizable monomers in the polymerizable monomer composition, i.e., styrene and n-butyl acrylate, were polymerized at a temperature of 85° C. for 5 hours while being stirred at a rate of 120 rpm to produce a slurry containing toner particles. The slurry was cooled after the polymerization. Hydrochloric acid was added to the cooled slurry so that pH was adjusted to 1.4, and the slurry was stirred for 1 hour to dissolve calcium phosphates. The resulting slurry was washed with water in an amount 10 times the amount of the slurry, filtered, and dried. Then, the particle size was controlled by classification. Thus, toner particles were obtained.

The toner particles each contained 85.0 parts by mass of styrene-acrylic resin, 15.0 parts by mass of polystyrene resin, 6.5 parts by mass of the cyan colorant, 9.0 parts by mass of the wax 1, 0.5 parts by mass of the negatively-charge-controlling agent, 0.7 parts by mass of the negatively-charge-controlling resin 1, and 5.0 parts by mass of polyester resin.

Into 100.0 parts by mass of the toner particles, 1.5 parts by mass of hydrophobic silica fine powder (primary particle size: 7 nm, BET specific surface area: 130 $m^2/g$), which was processed with dimethyl silicone oil in an amount of 20% by mass of the amount of silica fine powder, was mixed as an external additive while being stirred at a rate of 3000 rpm for 15 minutes with a Henschel mixer (produced by MITSUI MIIKE MACHINERY Co., Ltd.) to prepare toner 1. Table 3 shows the physical properties of the toner 1.

Preparation of Toners 2 to 13 and 16 to 20

Toners 2 to 13 and 16 to 20 were prepared in the same way as in preparation of toner 1 except that the raw materials and the number of parts added were changed as shown in Table 3. In the case where a crosslinking agent was used, the crosslinking agent was added at the same time as a raw material such as wax was added into the solution so as to be contained in the polymerizable monomer composition.

Preparation of Toner 14

| | |
|---|---|
| Polyester resin A (polycondensate of terephthalic acid/isophthalic acid/propylene oxide-modified bisphenol A (2 mol adduct)/ethylene oxide-modified bisphenol A (2 mol adduct) = 20:20:44:50 (mass ratio)) (Mw = 7,000, Mn = 3,200, Tg = 57° C.) | 75.0 parts by mass |
| Polyester resin B (polycondensate of terephthalic acid/trimellitic acid/propylene oxide-modified bisphenol A (2 mol adduct)/ethylene oxide-modified bisphenol A (2 mol adduct) = 24:3:70:2 (mass ratio)) (Mw = 11,000, Mn = 4,200, Tg = 52° C.) | 25.0 parts by mass |
| Methyl ethyl ketone | 100.0 parts by mass |
| Ethyl acetate | 100.0 parts by mass |
| Wax 4 | 9.0 parts by mass |
| Cyan colorant (C.I. Pigment Blue 15:3) | 6.5 parts by mass |
| Negatively-charge-controlling resin 1 | 1.0 parts by mass |

The above materials were dispersed for 3 hours using an attritor (produced by Mitsui Mining & Smelting Co., Ltd.) to form a colorant dispersion.

Meanwhile, into 3000 parts by mass of ion exchange water heated at a temperature of 60° C., 27 parts by mass of calcium phosphate was added and the mixture was stirred at a rate of 10,000 rpm with a T.K. HOMO MIXER (produced by Tokushu Kika Kogyo Co., Ltd.) to form an aqueous medium. The colorant dispersion was added in the aqueous medium and the mixture was stirred at a rate of 12,000 rpm for 15 minutes with a T.K. HOMO MIXER at a temperature of 65° C. in a N2 atmosphere to granulate colorant particles. The mixture was transferred from the T.K. HOMO MIXER to an ordinary propeller stirrer, the internal temperature was increased to and maintained at 95° C. for 3 hours while the rate of the stirrer was maintained at 150 rpm to remove the solvent from the dispersion, preparing a dispersion of toner particles.

Hydrochloric acid was added to the dispersion of toner particles so that pH was adjusted to 1.4, and the dispersion was stirred for 1 hour to dissolve calcium phosphates. The resulting dispersion was filtered and washed with a pressure filter to obtain toner aggregates. The toner aggregates were crushed and dried to form toner particles. The toner particles each contained 100 parts by mass of polyester resin, 6.5 parts by mass of the cyan colorant, 9.0 parts by mass of the wax 4, and 1.0 parts by mass of the negatively-charge-controlling resin 1. Into 100.0 parts by mass of the toner particles, 1.5 parts by mass of hydrophobic silica fine powder (primary particle size: 7 nm, BET specific surface area: 130 $m^2/g$), which was processed with dimethyl silicone oil in an amount of 20% by mass of the amount of silica fine powder, was mixed as an external additive while being stirred at a rate of 3000 rpm for 15 minutes with a Henschel mixer (produced by MITSUI MIIKE MACHINERY Co., Ltd.) to prepare toner 14. Table 3 shows the physical properties of the toner 14.

Preparation of Toner 15

Preparation of Resin Particle Dispersion 1

| | |
|---|---|
| Styrene | 75.0 parts by mass |
| n-Butyl acrylate | 25.0 parts by mass |
| Acrylic acid | 3.0 parts by mass |

These materials were mixed to prepare a solution. The solution was dispersed in a solution prepared by dissolving 1.5 parts by mass of a nonionic surfactant (produced by Sanyo Chemical Industries, Ltd.: NONIPOL 400) and 2.2 parts by mass of an anionic surfactant (produced by Dai-ichi Kogyo Seiyaku Co., Ltd.: NEOGEN SC) in 120 parts by mass of ion exchange water to form an emulsion. Into the emulsion, 1.5 parts by mass of ammonium persulfate dissolved in 10 parts by mass of ion exchange water was added as a polymerization initiator while the emulsion was mixing slowly for 10 minutes, and purged with nitrogen. Then, while the content was heated to and maintained at 70° C. with stirring, the emulsion polymerization was continued for 4 hours to prepare a resin particle dispersion 1 containing resin particles with an average particle size of 0.29 μm dispersed therein.

Preparation of Resin Particle Dispersion 2

| | |
|---|---|
| Styrene | 40.0 parts by mass |
| n-Butyl acrylate | 58.0 parts by mass |
| Divinylbenzene | 0.3 parts by mass |
| Acrylic acid | 3.0 parts by mass |

These materials were mixed to prepare a solution. The solution was dispersed in a solution prepared by dissolving 1.5 parts by mass of a nonionic surfactant (produced by Sanyo Chemical Industries, Ltd.: NONIPOL 400) and 2.2 parts by mass of an anionic surfactant (produced by Dai-ichi Kogyo Seiyaku Co., Ltd.: NEOGEN SC) in 120 parts by mass of ion exchange water to form an emulsion. Into the emulsion, 0.9 parts by mass of ammonium persulfate dissolved in 10 parts by mass of ion exchange water was added as a polymerization initiator while the emulsion was mixing slowly for 10 minutes, and purged with nitrogen. Then, while the content was heated to and maintained at 70° C. with stirring, the emulsion polymerization was continued for 4 hours to prepare resin particle dispersion 2 containing resin particles with an average particle size of 0.31 μm dispersed therein.

Preparation of Colorant Particle Dispersion

| | |
|---|---|
| Cyan colorant (C.I. Pigment Blue 15:3) | 20.0 parts by mass |
| Anionic surfactant (produced by Dai-ichi Kogyo Seiyaku Co., Ltd.: NEOGEN SC) | 3.0 parts by mass |
| Ion exchange water | 78.0 parts by mass |

These materials were mixed and dispersed using a sand grinder mill. The particle size distribution of the colorant particle dispersion 1 was determined using a particle size analyzer (LA-700, produced by HORIBA, Ltd.). The average particle size of colorant particles contained was 0.2 μm. Coarse particles of more than 1 μm were not observed.

Preparation of Wax Particle Dispersion

| | |
|---|---|
| Wax 4 | 50.0 parts by mass |
| Anionic surfactant (produced by Dai-ichi Kogyo Seiyaku Co., Ltd.: NEOGEN SC) | 7.0 parts by mass |
| Ion exchange water | 200.0 parts by mass |

These materials were heated to 95° C., dispersed using a homogenizer (produced by IKA Works, Inc.: ULTRA-TURRAX T50), and subjected to dispersion processing using a pressure-outflow-type homogenizer to prepare a wax particle dispersion containing wax with an average particle size of 0.5 μm dispersed therein.

Preparation of Charge-Controlling Particle Dispersion

| | |
|---|---|
| Metal compound of di-alkyl-salicylic acid (negatively-charge-controlling agent, BONTRON E-84, produced by Orient Chemical Industries Co., Ltd.) | 5.0 parts by mass |
| Anionic surfactant (produced by Dai-ichi Kogyo Seiyaku Co., Ltd.: NEOGEN SC) | 3.0 parts by mass |
| Ion exchange water | 78.0 parts by mass |

These materials were mixed and dispersed using a sand grinder mill.

Preparation of Liquid Mixture

| | |
|---|---|
| Resin particle dispersion 1 | 160.0 parts by mass |
| Resin particle dispersion 2 | 57.0 parts by mass |
| Colorant dispersion | 33.0 parts by mass |
| Wax particle dispersion | 45.0 parts by mass |

These materials were added into an 1-liter separable flask equipped with a stirrer, a cooling tube, and a thermometer and the liquid mixture was stirred. The liquid mixture was adjusted to a pH of 5.2 using 1 mol/L potassium hydroxide.

Into the liquid mixture, 120 parts by mass of an 8% aqueous sodium chloride solution was added dropwise as a flocculant, and heated to 55° C. with stirring. While maintaining the temperature, 2 parts by mass of the resin particle dispersion 3 and 10 parts by mass of the charge-controlling particle dispersion were added. After maintaining at 55° C. for 2 hours, an observation was made with an optical microscope. Then, formation of aggregated particles with an average particle size of about 3.3 μm was observed.

Then, 3 parts by mass of an anionic surfactant (produced by Dai-ichi Kogyo Seiyaku Co., Ltd.: NEOGEN SC) was further added, heated to 95° C. while stirring was continued, and maintained for 4.5 hours. The reaction product was filtered after cooling, sufficiently washed in ion exchange water, subjected to fluidized bed drying at 45° C., and the shape of the reaction product was adjusted by being dispersed in a gas phase at 200° C. to 300° C. using a spray dryer to prepare toner particles. The toner particles each contained 100 parts by mass of styrene-acrylic resin, 4.5 parts by mass of the cyan colorant, 9.0 parts by mass of the wax, and 0.6 parts by mass of the negatively-charge-controlling resin.

Into 100.0 parts by mass of the toner particles, 1.5 parts by mass of hydrophobic silica fine powder (primary particle size: 7 nm, BET specific surface area: 130 $m^2/g$), which was treated with dimethyl silicone oil in an amount of 20% by mass of the amount of silica fine powder, was mixed as an external additive while being stirred at a rate of 3000 rpm for 15 minutes with a Henschel mixer (produced by MITSUI MIIKE MACHINERY Co., Ltd.) to prepare toner 15. Table 3 shows the physical properties of the toner 15.

TABLE 3

| | | Wax | | Polymerization initiator | Crosslinking agent | | Physical properties | | | | |
|---|---|---|---|---|---|---|---|---|---|---|---|
| | Toner preparation method | Type of wax | Number of parts added (by mass) | Number of parts added (by mass) | Type of cross-linking agent | Number of parts added (by mass) | Softening point (° C.) | G'(70) (Pa) | G"(70) (Pa) | G'(160) (Pa) | G"(160) (Pa) |
| Toner 1 | Suspension polymerization method | Wax 1 | 9.0 | 12.0 | — | — | 95 | $6.0 \times 10^5$ | $8.6 \times 10^5$ | $2.7 \times 10^2$ | $5.7 \times 10^2$ |
| Toner 2 | Suspension polymerization method | Wax 2 | 9.0 | 12.0 | — | — | 97 | $6.1 \times 10^5$ | $8.2 \times 10^5$ | $2.4 \times 10^2$ | $5.5 \times 10^2$ |
| Toner 3 | Suspension polymerization method | Wax 3 | 9.0 | 12.0 | — | — | 96 | $5.7 \times 10^5$ | $8.5 \times 10^5$ | $2.1 \times 10^2$ | $5.3 \times 10^2$ |
| Toner 4 | Suspension polymerization method | Wax 4 | 9.0 | 12.0 | — | — | 97 | $5.9 \times 10^5$ | $8.6 \times 10^5$ | $2.6 \times 10^2$ | $5.7 \times 10^2$ |
| Toner 5 | Suspension polymerization method | Wax 5 | 9.0 | 12.0 | — | — | 98 | $6.2 \times 10^5$ | $8.4 \times 10^5$ | $2.2 \times 10^2$ | $5.4 \times 10^2$ |
| Toner 6 | Suspension polymerization method | Wax 6 | 9.0 | 12.0 | — | — | 92 | $6.0 \times 10^5$ | $8.1 \times 10^5$ | $2.5 \times 10^2$ | $5.2 \times 10^2$ |
| Toner 7 | Suspension polymerization method | Wax 1 | 3.0 | 12.0 | — | — | 105 | $1.1 \times 10^6$ | $9.2 \times 10^5$ | $3.0 \times 10^2$ | $6.9 \times 10^2$ |
| Toner 8 | Suspension polymerization method | Wax 1 | 14.0 | 12.0 | — | — | 91 | $9.5 \times 10^4$ | $3.5 \times 10^5$ | $1.9 \times 10^2$ | $3.5 \times 10^2$ |
| Toner 9 | Suspension polymerization method | Wax 1 | 2.0 | 12.0 | — | — | 108 | $1.8 \times 10^6$ | $9.2 \times 10^5$ | $3.7 \times 10^2$ | $6.5 \times 10^2$ |
| Toner 10 | Suspension polymerization method | Wax 1 | 16.0 | 12.0 | — | — | 85 | $8.9 \times 10^4$ | $3.0 \times 10^5$ | $1.2 \times 10^2$ | $2.2 \times 10^2$ |
| Toner 11 | Suspension polymerization method | Wax 4 | 9.0 | 7.0 | Divinylbenzene | 0.10 | 106 | $2.1 \times 10^6$ | $1.1 \times 10^7$ | $3.9 \times 10^2$ | $6.9 \times 10^2$ |
| Toner 12 | Suspension polymerization method | Wax 4 | 9.0 | 20.0 | Divinylbenzene | 0.05 | 79 | $8.5 \times 10^4$ | $2.2 \times 10^5$ | $9.2 \times 10$ | $9.6 \times 10$ |
| Toner 13 | Suspension polymerization method | Wax 4 | 9.0 | 7.0 | Divinylbenzene | 0.5 | 104 | $3.8 \times 10^6$ | $2.2 \times 10^7$ | $1.5 \times 10^3$ | $3.0 \times 10^3$ |
| Toner 14 | Dissolution suspension method | Wax 4 | 9.0 | — | — | — | 108 | $9.1 \times 10^5$ | $2.1 \times 10^6$ | $9.7 \times 10^2$ | $2.1 \times 10^3$ |
| Toner 15 | Emulsion aggregation method | Wax 4 | 9.0 | — | — | — | 102 | $6.1 \times 10^5$ | $8.6 \times 10^5$ | $2.7 \times 10^2$ | $5.7 \times 10^2$ |
| Toner 16 | Suspension polymerization method | Wax 8 | 9.0 | 12.0 | — | — | 95 | $5.8 \times 10^5$ | $8.2 \times 10^5$ | $2.7 \times 10^2$ | $5.7 \times 10^2$ |
| Toner 17 | Suspension polymerization method | Wax 7 | 9.0 | 12.0 | — | — | 95 | $6.3 \times 10^5$ | $8.5 \times 10^5$ | $2.6 \times 10^2$ | $5.4 \times 10^2$ |
| Toner 18 | Suspension polymerization method | Wax 9 | 9.0 | 12.0 | — | — | 93 | $6.2 \times 10^5$ | $8.9 \times 10^5$ | $2.9 \times 10^2$ | $5.8 \times 10^2$ |
| Toner 19 | Suspension polymerization method | Wax 10 | 9.0 | 12.0 | — | — | 92 | $5.9 \times 10^5$ | $7.9 \times 10^5$ | $2.1 \times 10^2$ | $5.6 \times 10^2$ |
| Toner 20 | Suspension polymerization method | Wax 11 | 9.0 | 12.0 | — | — | 99 | $6.2 \times 10^5$ | $9.2 \times 10^5$ | $2.5 \times 10^2$ | $5.7 \times 10^2$ |

Image Evaluation

Image evaluation was conducted using a commercially available color laser printer [HP Color LaserJet3525dn] that had been partially modified. The modification was made so that the printer worked even when a single-color process cartridge was installed therein and so that the temperature of the fixing unit could be changed to a desired temperature.

A toner contained in a process cartridge for black toner installed in the color laser printer was removed, and the interior was cleaned with an air blower. The process cartridge was filled with another toner (300 g), and the re-filled process cartridge was installed in the color laser printer. Then, the following image evaluation was conducted. The specific items for image evaluation were as follows.

Image Density

In a room-temperature, normal-humidity environment (temperature: 23° C./humidity: 60% RH), and in a high-temperature, high-humidity environment (temperature: 30° C./humidity: 85% RH), after a printing test in which 25000 sheets of images filled with horizontal lines at a coverage rate of 1% were printed, a solid image was printed, and evaluated on the basis of the image density in the solid region. A "MacBeth RD918 Reflection Densitometer" (produced by Macbeth) was used to determine the image density. The relative density of a white background region having an original density of 0.00 with respect to the printed out image was determined. Plain, letter-size paper (XEROX 4200 paper, produced by Xerox Corporation, 75 g/m$^2$) was used as a transfer material.

Evaluation Standard

A: 1.50 or more

B: 1.45 or more and less than 1.50

C: 1.35 or more and less than 1.45

D: 1.25 or more and less than 1.35

E: less than 1.25

Development Streaks

In a room-temperature, normal-humidity environment (temperature: 23° C./humidity: 60% RH), and in a high-temperature, high-humidity environment (temperature: 30° C./humidity: 85% RH), after a printing test in which 25000 sheets of images filled with horizontal lines at a coverage rate of 1% were printed, a halftone image (amount of toner deposited: 0.6 mg/cm$^2$) was printed out on letter-size XEROX 4200 paper (produced by Xerox Corporation, 75 g/m$^2$). Then, development streak evaluation was conducted.

Evaluation Standard

A: Absent

B: Development streaks were present at 1 site or more and 3 sites or less.

C: Development streaks were present at 4 sites or more and 6 sites or less.

D: Development streaks were present at 7 sites or more, or a development streak having a width of 0.5 mm or more was present.

Fogging

In a room-temperature, normal-humidity environment (temperature: 23° C./humidity: 60% RH), and in a high-temperature, high-humidity environment (temperature: 30° C./humidity: 85% RH), after a printing test in which 25000 sheets of images filled with horizontal lines at a coverage rate of 1% were printed and standing for 48 hours, the reflectance (%) of a non-image area of the printed out image was determined using a "REFLECTOMETER MODEL TC-6DS" (produced by Tokyo Denshoku Co., Ltd.). The evaluation was conducted based on a value (%) obtained by subtracting the reflectance from a reflectance (%) of unused print paper (standard paper) determined in the same manner. The smaller the value was, the more image fogging was suppressed. Plain paper (HP Brochure Paper 200 g, Glossy, produced by Hewlett-Packard Development Company, L.P., 200 g/m$^2$) was used in gloss-paper mode for the evaluation.

Evaluation Standard

A: Less than 0.5%

B: 0.5% or more and less than 1.5%

C: 1.5% or more and less than 3.0%

D: 3.0% or more

Gloss

A gloss value of a solid image (amount of toner deposited: 0.6 mg/cm$^2$) at a fixing temperature of 170° C. was determined using a PG-3D (produced by Nippon Denshoku Industries Co., Ltd.). Plain, letter-size paper (XEROX 4200 paper, produced by Xerox Corporation, 75 g/m$^2$) was used as a transfer material.

Evaluation Standard

A: Gloss value was 30 or more

B: Gloss value was 20 or more and less than 30

C: Gloss value was 15 or more and less than 20

D: Gloss value was less than 15

Low-Temperature Fixability

The evaluation was conducted by fixing a solid image (amount of toner deposited: 0.6 mg/cm$^2$) to a transfer material at various fixing temperatures. The fixing temperature was measured on the surface of the fixing roller with a non-contact thermometer. Plain, letter-size paper (XEROX 4200 paper, produced by Xerox Corporation, 75 g/m$^2$) was used as a transfer material.

A: Offset did not occur at 100° C.

B: Offset occurred at 100° C.

C: Offset occurred at 110° C.

D: Offset occurred at 120° C.

High-Temperature Fixability

The evaluation was conducted by fixing a solid image (amount of toner deposited: 0.6 mg/cm$^2$) to a transfer material at various fixing temperature (200° C. to 220° C.) The fixing temperature was measured on the surface of the fixing roller with a non-contact thermometer. Plain, letter-size paper (XEROX 4200 paper, produced by Xerox Corporation, 75 g/m$^2$) was used as a transfer material.

A: Offset did not occur at 210° C.

B: Offset occurred at 210° C.

C: Offset occurred at 200° C.

D: Offset occurred at 190° C.

Interior Contamination Evaluation

A level of contamination around the fixing unit was visually evaluated using a commercially available color laser printer (HP Color LaserJet3525dn).

The evaluation chart used was an original chart in which the coverage rate of each color was 5% (full-color coverage rate 20%). A cyan cartridge re-filled with each of the toners prepared above was installed in each of the stations of yellow, magenta, cyan, and black. The cartridges were changed each time the toner ran out during the evaluation.

In a room-temperature, normal-humidity environment (temperature: 23° C./humidity: 60% RH), and in a low-temperature, low-humidity environment (temperature: 10° C./humidity: 15% RH), a printing test with a total of 500,000 sheets of letter-size XEROX 4200 paper (produced by Xerox Corporation, 75 g/m$^2$) was conducted in plain-paper mode.

A level of contamination around the fixing unit was visually evaluated in accordance with the following standards:

A: Little contamination was observed around the fixing unit

B: Trace contamination was observed around the fixing unit

C: Spreading contamination was clearly observed at the fixing guide unit

D: A considerable amount of contamination was observed around the fixing unit and image defects occurred Examples 1 to 15

Examples 1 to 15 used the toners 1 to 15 as toners, respectively, and the above-described evaluations were conducted. Table 4 shows the results of the evaluations.

Comparative Examples 1 to 5

Comparative examples 1 to 5 used the toners 16 to 20 as toners, respectively, and the above-described evaluations were conducted. Table 4 shows the results of the evaluations.

TABLE 4

| | | Image density | | Development streaks (Number of spots) | | Fogging | | | Low-temperature fixability | High-temperature fixability | Inside contamination | |
|---|---|---|---|---|---|---|---|---|---|---|---|---|
| | | Room-temperature normal-humidity | High-temperature high-humidity | Room-temperature normal-humidity | High-temperature high-humidity | Room-temperature normal-humidity | High-temperature high-humidity | Gloss | | | Room-temperature normal-humidity | Low-temperature low-humidity |
| Example 1 | Toner 1 | A (1.60) | A (1.55) | A (0) | A (0) | A (0.3) | A (0.2) | A (35) | A | A | A | A |
| Example 2 | Toner 2 | A (1.55) | A (1.50) | A (0) | A (0) | A (0.1) | A (0.3) | A (34) | A | A | A | A |
| Example 3 | Toner 3 | A (1.57) | A (1.53) | A (0) | A (0) | A (0.2) | A (0.3) | A (36) | A | A | A | A |
| Example 4 | Toner 4 | A (1.54) | A (1.52) | A (0) | A (0) | A (0.3) | B (0.6) | A (38) | A | A | A | B |
| Example 5 | Toner 5 | A (1.58) | A (1.55) | A (0) | A (0) | A (0.2) | A (0.3) | A (32) | B | A | A | A |
| Example 6 | Toner 6 | A (1.52) | B (1.47) | A (0) | B (1) | A (0.3) | B (0.8) | A (40) | A | A | B | C |
| Example 7 | Toner 7 | A (1.54) | A (1.51) | A (0) | A (0) | A (0.2) | A (0.4) | A (33) | A | A | A | A |
| Example 8 | Toner 8 | A (1.56) | A (1.53) | A (0) | A (0) | A (0.1) | A (0.3) | A (39) | A | A | A | A |
| Example 9 | Toner 9 | A (1.55) | A (1.52) | A (0) | A (0) | A (0.1) | A (0.4) | B (29) | A | B | A | A |
| Example 10 | Toner 10 | A (1.56) | A (1.53) | A (0) | B (2) | A (0.4) | B (1.1) | A (40) | A | A | A | B |
| Example 11 | Toner 11 | A (1.57) | A (1.55) | A (0) | A (0) | A (0.3) | A (0.4) | A (32) | B | A | A | B |
| Example 12 | Toner 12 | A (1.52) | B (1.48) | A (0) | C (4) | A (0.2) | B (0.9) | A (38) | A | B | B | C |
| Example 13 | Toner 13 | A (1.54) | A (1.51) | A (0) | A (0) | A (0.2) | A (0.4) | B (22) | C | A | A | A |
| Example 14 | Toner 14 | A (1.55) | A (1.53) | A (0) | B (1) | A (0.4) | B (1.0) | B (28) | A | A | A | B |
| Example 15 | Toner 15 | A (1.52) | A (1.50) | A (0) | B (2) | A (0.2) | B (1.2) | A (34) | A | A | B | C |
| Comparative example 1 | Toner 16 | A (1.51) | B (1.47) | B (1) | C (5) | A (0.3) | C (1.7) | A (36) | A | A | B | D |
| Comparative example 2 | Toner 17 | A (1.50) | B (1.45) | A (0) | B (3) | A (0.2) | B (0.8) | A (37) | A | A | B | D |
| Comparative example 3 | Toner 18 | B (1.47) | C (1.38) | B (1) | C (6) | A (0.2) | C (2.1) | A (39) | A | C | B | D |
| Comparative example 4 | Toner 19 | B (1.45) | D (1.22) | B (3) | D (9) | A (0.4) | D (3.5) | A (40) | A | C | C | D |
| Comparative example 5 | Toner 20 | A (1.51) | B (1.46) | A (0) | A (0) | A (0.3) | A (0.3) | B (22) | D | A | A | A |

The present invention provides a toner capable of producing good toner images for a long period of time while maintaining a broad fixing temperature range and capable of reducing interior contamination in long-term use.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A toner comprising toner particles, each of which contains a binder resin, a colorant, and a wax, wherein:

the toner has a softening point of 75° C. or more and 110° C. or less measured by a constant-pressure-extrusion-type capillary rheometer, the wax is a hydrocarbon wax composed of a hydrocarbon compound, and wherein:

in a carbon number distribution chart showing carbon number on an abscissa and abundance (area %) of the hydrocarbon compound on an ordinate, the carbon number distribution chart being drawn based on analytical values obtained by analyzing the hydrocarbon wax by gas chromatography, (i) a carbon number showing the maximum abundance is present within a range of 40 or more and 45 or less, and an abundance at the carbon number showing the maximum abundance is 6.5 area % or more, and 9.0 area % or less, (ii) a total sum of abundances in a carbon number range of 33 or less is 4.0 area % or less, (iii) a total sum of abundances in a carbon number range of 34 or more, and 38 or less, is 12.0 area % or more and 25.0 area % or less, and (iv) a total sum of abundances in a carbon number range of 50 or more is 5.0 are a% or more and 15.0 area % or less.

2. The toner according to claim 1, wherein a total sum of abundances in a carbon number range of 34 or more, and 36 or less in the carbon number distribution chart, is 5.0 area % or more and 10.0 area % or less.

3. The toner according to claim 1, wherein a total sum of abundances in a carbon number range of 30 or less in the carbon number distribution chart, is 1.0 area % or less.

4. The toner according to claim 1, wherein the hydrocarbon wax is a straight-chain aliphatic hydrocarbon wax composed of a straight-chain aliphatic hydrocarbon compound.

5. The toner according to claim 1, wherein a content of the hydrocarbon wax in the toner is 3.0 parts by mass or more, and 15.0 parts by mass or less relative to 100.0 parts by mass of the binder resin.

6. The toner according to claim 1, wherein the toner has a storage modulus G'(70) of $5.0 \times 10^4$ Pa or more and $1.0 \times 10^6$ Pa or less at a temperature of 70° C., and a loss modulus G"(70) of $2.0 \times 10^4$ Pa or more and $1.0 \times 10^7$ Pa or less at a temperature of 70° C. in dynamic viscoelasticity measurement.

7. The toner according to claim 1, wherein the toner has a storage modulus G'(160) of $2.0 \times 10^2$ Pa or more and $1.0 \times 10^3$ Pa or less at a temperature of 160° C., and a loss modulus G"(160) of $1.0 \times 10^2$ Pa or more and $1.0 \times 10^3$ Pa or less at a temperature of 160° C. in dynamic viscoelasticity measurement.

8. The toner according to claim 1, wherein the toner particles are produced by a process comprising:

(a) a granulating step of dispersing a polymerizable monomer composition that contains a polymerizable monomer, the colorant, and the wax in an aqueous medium to form droplets of the polymerizable monomer composition; and (b) a polymerizing step of polymerizing the polymerizable monomer in the droplets.

* * * * *